United States Patent [19]

Ikenoue et al.

[11] 4,120,728

[45] Oct. 17, 1978

[54] THERMALLY DEVELOPABLE LIGHT-SENSITIVE MATERIAL

[75] Inventors: Shinpei Ikenoue; Takao Masuda, both of Asaka, Japan

[73] Assignee: Fuji Photo Film Co., Ltd., Minami-ashigara, Japan

[21] Appl. No.: 680,417

[22] Filed: Apr. 26, 1976

Related U.S. Application Data

[63] Continuation of Ser. No. 491,010, Jul. 23, 1974, abandoned.

[30] Foreign Application Priority Data

Jul. 23, 1973 [JP] Japan ..... 48-82852

[51] Int. Cl.$^2$ ..... G03C 1/02; G03C 1/38

[52] U.S. Cl. ..... 96/114.1; 96/94 BF; 96/114.5

[58] Field of Search ..... 96/114.1, 94 BF, 114.5

[56] References Cited

U.S. PATENT DOCUMENTS

| | | | |
|---|---|---|---|
| 2,756,146 | 7/1956 | Levy | 96/114.1 |
| 3,152,904 | 10/1964 | Sorensen | 96/76 |
| 3,434,841 | 3/1969 | Kuhrt | 96/94 |
| 3,457,075 | 7/1969 | Morgan et al. | 96/114.1 |
| 3,761,273 | 9/1973 | Miller et al. | 96/94 |
| 3,778,268 | 12/1973 | Ushiyama et al. | 96/114.5 |
| 3,811,889 | 5/1974 | Endou et al. | 96/114.5 |

*Primary Examiner*—Dennis E. Talbert, Jr.
*Assistant Examiner*—L. V. Falasco
*Attorney, Agent, or Firm*—Sughrue, Rothwell, Mion, Zinn and Macpeak

[57] ABSTRACT

A thermally developable light-sensitive material comprising a support having thereon at least one layer containing (a) an organic silver salt; (b) a catalytic amount of a light-sensitive silver halide prepared by mixing a solution of a compound capable of releasing a halide ion and a solution of a compound capable of releasing silver ion in the presence of a surface active agent; (c) a reducing agent and (d) a binder.

54 Claims, No Drawings

THERMALLY DEVELOPABLE LIGHT-SENSITIVE MATERIAL

This is a Continuation, of application Ser. No. 491,010, filed July 23, 1974 now abandoned.

BACKGROUND OF THE INVENTION

1. Field of the Invention

This invention relates to a high sensitivity thermally developable light-sensitive material containing a light-sensitive silver halide catalyst prepared by a specific method.

2. Description of the Prior Art

Photographic methods using silver halides have hitherto been used most widely, which are superior in photographic properties such as sensitivity and gradation to electrophotographic methods and diazophotographic methods. However, the silver halide light-sensitive material used in such a photographic method is imagewise exposed, developed with a developing solution and then subjected to several processings such as stopping, fixing, water washing or stabilizing for the purpose of preventing the developed image from discoloration or fading and preventing the non-developed area (which will hereinafter be referred to as "background") from blackening. Therefore, this method has a disadvantage that these processings take much time and are laborsome and the handling of chemicals results in an injury to the human body and a contamination of workers' hands and clothes, and processing areas.

In the photographic method using a silver halide, therefore, it is very desirable to effect the processings in a dry condition without using solutions as well as to maintain the processed image stable.

To this end, many efforts have been made up to the present time. For example, a thermally developable light-sensitive material as disclosed in U.S. Pat. Nos. 3,152,904, 3,457,075, 3,635,719 and 3,645,739 and Japanese Patent Publications 22185/1970 and 41865/1971 has been proposed. In this proposal, a light-sensitive element is used consisting of a silver salt of a long chain aliphatic carboxylic acid such as behenic acid, silver saccharin or silver benzotriazole and a catalytic amount of a silver halide.

The present invention relates to this thermally developable light-sensitive material. U.S. Pat. No. 3,457,075 describes a method of forming a catalytic amount of a light-sensitive silver halide used in the above described heat developable light-sensitive material, which comprises reacting an organic silver salt with a reactive and ionizable halide to form a light-sensitive silver halide. The description is that this light-sensitive silver halide catalyst is contacted catalytically with substantially all clusters of silver ions in the organic silver salt having silver ions associating in a cluster in its molecule, so that the catalyst is highly sensitive.

However, a light-sensitive silver halide catalyst having a sufficient sensitivity from a practical standpoint cannot be obtained by this method. For example, it is very difficult to apply the well-recognized sensitizing technique for ordinary silver halide emulsions (for wet development) such as sensitization by increasing the grain size of the silver halide or by using a chemical sensitizer with the light-sensitive silver halide catalyst prepared by this method due to the presence of, with the silver halide, a more unstable (reactive) organic silver salt than the silver halide.

If the silver halide catalyst can be prepared independently of the organic silver salt, it would be possible to apply known sensitizing techniques used with ordinary silver halide photographic emulsions. However, silver halide grains prepared in the presence of a protective colloid such as gelatin in order to prevent the silver halide from aggregation are not suitable for use as a light-sensitive silver halide catalyst for a thermally developable light-sensitive material, because the protective colloid of the silver halide adsorbs strongly on the silver halide, resulting in an inadequate contact of the silver halide and organic silver salt. However, a silver halide prepared in the absence of a protective colloid is also not suitable for the light-sensitive silver halide catalyst, because the silver halide in the absence of the protective colloid tends to aggregate and thus is not brought into catalytic contact the organic silver salt. This is apparent from U.S. Pat. Nos. 3,152,904 and 3,457,075. According to U.S. Pat. No. 3,457,075, for example, the thermally developable light-sensitive material prepared by mixing only silver chloride and silver saccharin as in Example 2 of U.S. Pat. No. 3,152,904 has a very low sensitivity since the silver chloride and silver saccharin are not brought into catalytic contact. In fact, the sensitivity is low.

SUMMARY OF THE INVENTION

It is an object of the present invention to provide a high sensitivity thermally developable light-sensitive material.

It is another object of the invention to provide a thermally developable light-sensitive material containing a light-sensitive silver halide prepared by a novel method.

It is a further object of the invention to provide a high sensitivity thermally developable light-sensitive material containing a light-sensitive silver halide prepared in the absence of a binder as a protective colloid.

Various studies have been made in order to accomplish the above described objects and a phenomenon has been found which can be applied to the preparation of a light-sensitive silver halide suitable for a thermally developable light-sensitive material which has a much higher sensitivity than the light-sensitive silver halide catalysts prepared according to the methods of U.S. Pat. Nos. 3,457,075 and 3,152,904.

That is to say, it has been found that a silver halide formed in the presence of a surfactant is composed of very fine grains, is stable and hardly aggregates in spite of the absence of a polymer such as gelatin as a protective colloid. Furthermore, it is found that a high sensitivity thermally developable light-sensitive material capable of giving an image through irradiation with light within the silver halide sensitive range followed by heating can be obtained by mixing the silver halide grains prepared using this method with a polymer solution in which an organic silver salt is dispersed, further adding a reducing agent thereto, coating the resulting mixture onto a support member and then drying.

A thermally developable light-sensitive material comprising a support having thereon, at least one layer containing (a) an organic silver salt; (b) a catalytic amount of a light-sensitive silver halide prepared by mixing a solution of a compound capable of releasing a halide ion and a solution of a compound capable of releasing silver ion in the presence of a surface active agent; (c) a reducing agent and (d) a binder.

DETAILED DESCRIPTION OF THE INVENTION

Many kinds of surface active agents can be used for the preparation of the light-sensitive silver halide of the invention. That is to say, cationic surfactants, anionic surfactants, amphoteric surfactants and nonionic surfactants are used, but cationic surfactants and nonionic surfactants are most preferred. For example, a cationic surfactant having a halide ion as a counter ion is preferred since it acts as a compound capable of releasing the halide ion that reacts with the silver ion to form the silver halide. A cationic surfactant having an ion forming a water-soluble salt, such as a nitrate ion, as a counter ion does not react with silver ion. Nonionic surfactants do not react with silver ion.

The silver halide formed in an emulsion of a less water-soluble solvent and water prepared in the presence of a surfactant is sufficiently stabilized and prevented from aggregating. For example, silver bromide formed by adding and emulsifying toluene in an aqueous solution of cetylethyldimethylammonium bromide serving both as a surfactant and silver halide forming agent and adding an aqueous solution of silver nitrate is so stable that the silver bromide does not aggregate and remains uniformly dispersed. Moreover, silver bromide formed by adding an aqueous solution of silver nitrate to an aqueous solution of cetylethyldimethylammonium bromide is stable and hardly aggregates, but, after the passage of one day from the formation of the silver bromide, the silver bromide aggregates to some extent and precipitates on the bottom of the container. However, the turbidity of the solution immediately after the silver bromide is formed scarcely varies. In the case of adding an aqueous solution of silver nitrate to an aqueous solution of potassium bromide, on the other hand, the thus formed silver bromide aggregates and precipitates on the bottom of the container and the supernatant solution becomes completely transparent.

It is apparent from this example that the presence of a surfactant prevents silver halide from aggregating. A cationic surfactant is most suitable for the present invention in that it has the action of preventing silver halide from aggregating and no precipitates but silver halides are formed on reaction with the $Ag^+$ if the anion is suitably selected.

Specific examples of cationic surface active agents, are ammonium salts which include the compounds represented by the general formula (I),

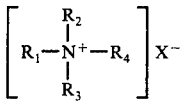

(I)

wherein $R_1$ is an alkyl group having 8 to 22 carbon atoms, preferably 12 to 18 carbon atoms such as dodecyl, tetradecyl, hexadecyl, and octadecyl; $R_2$, $R_3$ and $R_4$ each is an alkyl group having 1 to 10 carbon atoms, preferably 1 to 4 carbon atoms such as methyl, ethyl, propyl, and butyl, or an aralkyl group such as benzyl, phenylethyl, methylbenzyl, naphthylmethyl, etc.; and $X^-$ is a halogen ion such as bromide, chloride or iodide, capable of forming silver halide when reacted with silver ion, or an ion incapable of forming a weakly soluble silver compound when reacted with silver ion, such as nitrate ion or perchlorate ion.

The typical examples of ammonium salts represented by the general formula (I) are as follows:

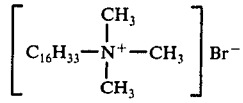

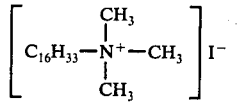

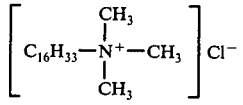

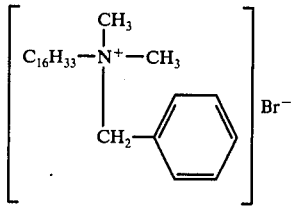

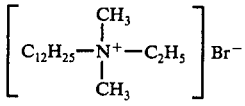

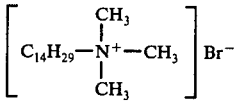

An another type of ammonium salt is an alkyl pyridinium salt which includes the compounds represented by the general formula (II),

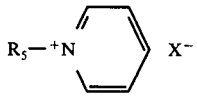

(II)

wherein $R_5$ is an alkyl group having 8 to 22 carbon atoms, preferably 12 to 18 carbon atoms as defined for $R_1$; and X is as defined with respect to the general formula (I). The pyridine ring can be substituted with a substituent such as an alkyl group or an aryl group, e.g., methyl, ethyl, propyl, phenyl, tolyl, etc.

The typical examples of the compounds represented by the general formula (II) are as follows:

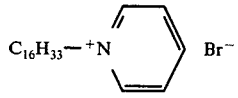

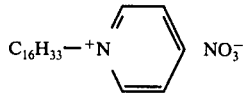

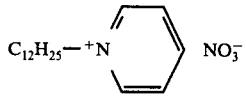

-continued

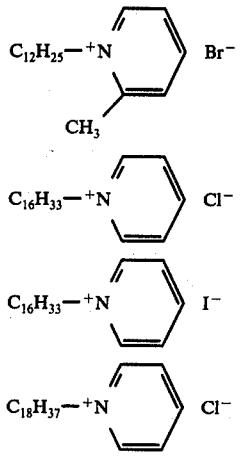

A non-ionic surface active agent can be suitably used in the process of invention even though it does not react with silver ion.

Typical examples of non-ionic surfactants are alkylether type compounds and alkylaryl ether type compounds. More specific compounds can be represented by the general formula (III) and (IV).

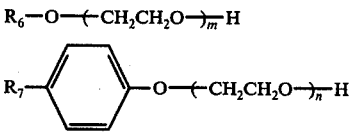

(III)

(IV)

wherein $R_6$ is an alkyl group having 8 to 22 carbon atoms, preferably 12 to 18, as defined for $R_1$, $R_7$ is an alkyl group having 4 to 10 carbon atoms (e.g., butyl, pentyl, hexyl, heptyl, octyl, nonyl, and decyl), and $m$ and $n$ each is an integer of 8 to 50.

Specific examples of compounds represented by the general formulae (III) and (IV) are as follows:

$C_{12}H_{25}—O—(CH_2CH_2O)_{20}H$ $C_{18}H_{37}—O—(CH_2CH_2O)_{12}H$ $C_{14}H_{29}—O—(CH_2CH_2O)_{15}H$

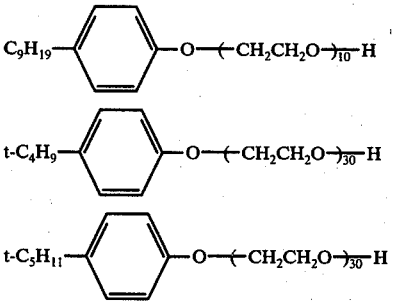

Further, an alkylester type non-ionic surfactant and a sorbitan monoalkylester type non-ionic surfactant are effective. For example, such compounds can be represented by the general formulae (V) or (VI), $R_8 — COO—(CH_2CH_2O)_p H$ (V)

$R_8 — COO—(CH_2CH_2O)_{p-1}CH_2CH_2COOR_8$ (VI)

wherein $R_8$ is an alkyl group having 8 to 18 carbon atoms (e.g., octyl, nonyl, decyl, dodecyl, tetradecyl, hexadecyl, and octadecyl) and $n$ is an integer of 3 to 40, or the general formula (VII),

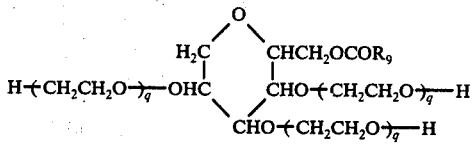

wherein $R_9$ is an alkyl group having 8 to 18 carbon atoms, e.g., as defined for $R_8$ and $q$ is an integer of 5 to 30.

Typical examples of compounds represented by the general formulae (V), (VI) and (VII) are as follows:

$C_{14}H_{29}—COO—(CH_2CH_2O)_{10}H$ $C_{14}H_{29}—COO—(CH_2CH_2O)_9CH_2CH_2COOC_{14}H_{29}$ $C_{16}H_{33}—COO—(CH_2CH_2O)_{22}H$ $C_{16}H_{33}—COO—(CH_2CH_2O)_{16}CH_2CH_2COOC_{17}H_{35}$

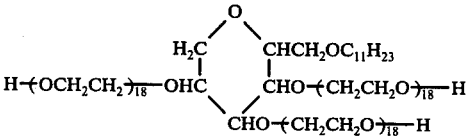

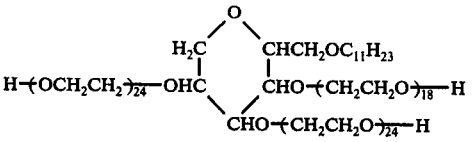

Still further, a polyoxyethylene alkylamine type non-ionic surfactant is effective in the invention. For example, these compounds can be represented by the general formula (VIII),

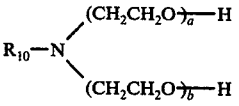

(VIII)

wherein $R_{10}$ is an alkyl group having 8 to 18 carbon atoms, e.g., as defined for $R_8$, and $a$ and $b$ each is an integer of 0 to 20, and the sum of $a + b$ ranges from 6 to 40.

Typical examples of compounds of the general formula (VIII) are as follows:

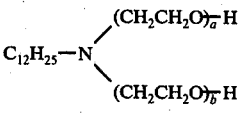

(a + b = 20)

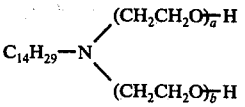

(a + b = 10)

$C_{18}H_{37}—NH—(CH_2CH_2O)_{20}H$

Typical examples of anionic surfactants are those compounds having the general formula (IX)

$$R_{11}COOM \quad (IX)$$

wherein $R_{11}$ is an alkyl group having 10 to 22 carbon atoms, and M is sodium, potassium or ammonium.

Suitable specific examples thereof include sodium laurate, ammonium laurate, potassium myristate, sodium palmitate, ammonium stearate, etc.

Suitable examples of amphoteric surfactants, can be represented by the general formula (X) and (XI)

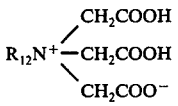

(X)

wherein $R_{12}$ is an alkyl group having 12 to 18 carbon atoms, e.g., as defined for $R_1$;

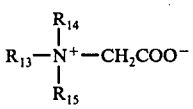

(XI)

wherein $R_{13}$ is an alkyl group having 12 to 18 carbon atoms, e.g., as defined for $R_1$; and $R_{14}$ and $R_{15}$ each is an alkyl group having 1 to 4 carbon atoms, e.g., as defined for $R_2$.

Suitable specific examples of these amphoteric surface active agents are as follows:

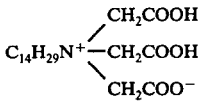

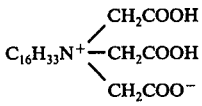

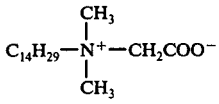

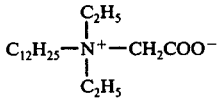

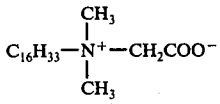

Although it is most preferred that a surfactant be used in an aqueous solution, it can be used in another polar solvent such as methanol, ethanol, dimethyl formamide or dimethyl sulfoxide. Water is most preferred. The concentration of the surfactant is about 0.3 to 30 wt%, preferably 1 to 10 wt%. A suitable molar ratio of the silver halide to the surface active agent can range from about 1:8 to 1:0.01, preferably 1:4 to 1:0.1.

In addition, a slightly water-soluble solvent (e.g., 10 parts or less per 100 parts of water, preferably 2 parts or less per 100 parts of water, at 20° C.) can be utilized in order to enhance the protection of silver halide from coagulation and to disperse the silver halide in the oil phase. The combined use of water and a slightly water-soluble solvent is preferred; a suitable ratio of these solvents to water ranges from about 1:10 to 10:1, preferably 1:6 to 6:1.

Examples of these solvents are tricresyl phosphate, tributyl phosphate, monooctyl dibutyl phosphate, dimethyl phthalate, dioctyl phthalate, dimethoxyethyl phthalate, amyl acetate, isoamyl acetate, isobutyl acetate, isopropyl acetate, ethyl acetate, 2-ethylbutyl acetate, butyl acetate, propyl acetate, dioctyl sebacate, dibutyl sebacate, diethyl sebacate, diethyl succinate, propyl formate, butyl formate, amyl formate, ethyl valerate, diethyl tartrate, methyl butyrate, ethyl butyrate, butyl butyrate, isoamyl butyrate, benzene, toluene, xylene, pentene, hexane, heptane, and cyclohexane.

Silver halide grains can be prepared using any known method, for example, by adding a solution containing a compound capable of releasing silver ion to a solution containing a compound capable of releasing a halide ion, by simultaneously mixing a solution containing a halide ion and a solution containing silver ion and by adding a solution containing a halide ion to a solution containing silver ion. The solutions containing a halide ion and silver ion are ordinarily used in the form of aqueous solutions, but can be also used in the form of solutions in other polar solvents such as methanol, ethanol, dimethylformamide and dimethyl sulfoxide.

A surfactant is incorporated in one or both of a solution of a compound capable of releasing a halide ion and a solution of a compound capable of releasing silver ion. Both solutions can be added to a solution containing a surfactant. A suitable molar ratio of the silver halide to the surface active agent can range from about 1:8 to 1:0.01, preferably 1:4 to 1:0.1.

Compounds capable of releasing a halide ion are, for example, inorganic compounds represented by the general formula, $$MX'_{n_1}$$

in which M represents a hydrogen atom, an ammonium group or a metal (such as strontium, cadmium, zinc, tin, chromium, sodium, barium, iron, cesium, lanthanum, copper, calcium, nickel, magnesium, potassium, aluminum, antimony, gold, cobalt, mercury, lead, beryllium, lithium, manganese, gallium, indium, rhodium, ruthenium, palladium, iridium, platinum, thallium or bismuth atom, X' represents a halogen atom such as chlorine, bromine or iodine and $n_1$ represents 1 when M is a hydrogen atom or an ammonium group and, when M is a metal atom, $n_1$ represents the valence of the metal. Furthermore, compounds capable of releasing a halide ions include organic halogen compounds such as triphenylmethyl chloride, triphenylmethyl bromide, monoiodoacetic acid, N-bromosuccinimide, N-iodosuccinimide, N-bromoacetamide, N-iodoacetamide, iodoform and carbon tetrabromide. These compounds can be used either alone or in combination and the concentration thereof can be freely varied within a range of from about $10^{-4}$ mol/l to a saturated solution thereof. Those compounds which release a halogen ion having a solubility of 1 g/100 ml of water at 20° C. are preferred.

As a compound capable of releasing silver ion, silver nitrate is used ordinarily, but other water-soluble silver salts whose solubility at 20° C. is 0.2 g/100 g-water or higher, for example, silver perchlorate, silver sulfate and silver acetate can be used. The silver can may be in the form of a complex ion such as a silver ammonium complex salt or a silver amine salt. The concentration of the silver-ion-releasing compound can optionally be varied within a range of from about $10^{-4}$ mol/l to a saturated solution thereof.

The reaction temperature of the compound capable of releasing a halide ion and the compound capable of releasing silver ion can range up to less than the boiling point of the solvent and, in general, ranges from about 0° to 80° C., preferably 5° to 50° C.

Illustrative silver halides which can be used in the invention are silver chloride, silver bromide, silver iodide, silver chlorobromide, silver iodobromide, silver chloroiodobromide and mixtures thereof.

As described above, the silver halide is sufficiently stabilized and prevented from aggregating in an emulsion in which water and a slightly water-soluble solvent are emulsified in the presence of a surfactant. In this case, the slightly water-soluble solvent can be added at any step in forming the silver halide, that is, before, during or after forming the silver halide. The emulsification can be carried out in a conventional manner, for example, using a shaking apparatus, a mixer, a colloid mill, a homogenizer or an ultrasonic wave.

The component (a) of the invention is an organic silver salt or a silver salt of an organic compound having an imino group, a mercapto group or a carboxyl group. A particularly preferred organic silver salt for the present invention is a silver salt of an aliphatic carboxylic acid having 10 or more carbon atoms. Illustrative examples of organic silver salts are silver benzotriazole, silver saccharin, silver phthalazinone, the silver salt of 3-mercapto-4-phenyl-1,2,4-triazole, the silver salt of 4-hydroxy-6-methyl-1,3,3*a*,7-tetrazaindene, the silver salt of 2-(S-ethylthioglycolamide)-benzothiazole, silver caprate, silver laurate, silver myristate, silver palmitate, silver stearate, silver behenate, silver adipate, and silver sebacate.

The amount of the component (b) prepared by the method of the invention which can be added is about 0.001 to 0.5 mol, preferably 0.01 to 0.3 mol per 1 mol of the organic silver salt (a). If the amount of the component (b) is less than this range, the sensitivity is reduced, while, if the amount is greater than this range, the non-image area blackens gradually to reduce the contrast of an image area when a heated and developed material is allowed to stand under room light.

As the component (c) of the invention, that is, the reducing agent, a material suitable for reducing an organic silver salt and forming a silver image when heated in the presence of an exposed silver halide catalyst should be used. A suitable reducing agent is chosen depending on the combination with an organic silver salt and suitable examples thereof are substituted phenols, substituted or non-substituted bisphenols, di- or polyhydroxybenzenes, di- or polyhydroxynaphthalenes, substituted or non-substituted naphthols, hydroquinone monoethers, ascorbic acid or its derivative, 3-pyrazolidones, pyrazoline-5-ones, reducing saccharides, kojic acid and hinokitiol. Substituted phenols and substituted and unsubstituted bisphenols are preferred.

Specific examples of these compounds are as follows: hydroquinone, phenylhydroquinone, hydroquinonemonosulfonate, t-octylhydroquinone, t-butylhydroquinone, 2,5-dimethylhydroquinone, methylhydroquinone, chlorohydroquinone, bromohydroquinone, 2,6-dimethylhydroquinone, methoxyhydroquinone, ethoxyhydroquinone, β-methoxyphenol, p-ethoxyphenol, hydroquinone monobenzyl ether, catechol, pyrogallol, resorcinol, p-aminophenol, o-aminophenol, N-methyl-p-aminophenol, 2-methoxy-4-aminophenol, 2,4-diaminophenol, 2-β-hydroxyethyl-4-aminophenol, p-t-butylphenol, p-t-amylphenol, p-cresol, 2,6-di-t-butyl-p-cresol, p-acetophenol, p-phenylphenol, o-phenylphenol, 1,4-dimethoxyphenol, 3,4-xylenol, 2,4-xylenol, 2,6-dimethoxyphenol, sodium 1-amino-2-naphthol-6-sulfonate, 1-naphthylamine-7-sulfonic acid, 1-hydoxy-4-methoxy-naphthalene, 1-hydroxy-4-ethoxynaphthalene, 1,4-dihydroxynaphthalene, 1,3-dihydroxynaphthalene, 1-hydroxy-4-aminonaphthalene, 1,5-dihydroxynaphthalene, 1-hydroxy-2-phenyl-4-methoxynaphthalene, 1-hydroxy-2-methyl-4-methoxynaphthalene, α-naphthol, β-naphthol, 1,1'-dihydroxy-2,2'-binaphthyl, 4,4'-dimethoxy-1,1'-dihydroxy-2,2'-binaphthyl, 6,6'-diobromo-2,2'-dihydroxy-1,1'-binaphthyl, 6,6'-dinitro-2,2'-dihydroxy-1,1'-binaphthyl, bis(2-hydroxy-1-naphthyl)-methane, bisphenol A, 1,1-bis-(2-hydroxy-3,5-dimethylphenyl)-3,5,5-trimethylhexane, 2,2,4-trimethylpentyl-bis-(2-hydroxy-3,5-dimethylphenyl)methane, bis(2-hydroxy-3-t-butyl-5-methylphenyl)-methane, bis(2-hydroxy-3,5-di-t-butylphenyl)methane, 4,4'-methylenebis(3-methyl-5-t-butylphenol), 4,4'-methylenebis(2,6-di-t-butylphenol), 2,2'-methylenebis(2-t-butyl-4-ethylphenol), 2,6-bis(2-hydroxy-3-t-butyl-5-methylbenzyl)-4-methylphenol, 3,3',5,5'-tetra-t-butyl-4,4'-dihydroxybiphenyl, 1-ascorbic acid, 1-ascorbic acid monoester, 1-ascorbic acid diester, p-oxyphenylglycine, N,N-diethyl-p-phenylenediamine, furoin, benzoin, dihydroxyacetone, glycerine aldehyde, rodizonic acid-tetrahydroxyquinone, methyl gallate, propyl gallate, hydroxytetrolic acid, N,N-di(2-ethoxyethyl)hydroxyamine, glucose, lactose, 1-phenyl-3-pyrazolidone, 4-methyl-4-hydoxymethyl-1-phenyl-3-pyrazolidone, bis(3-methyl-4-hydroxy-5-t-butylphenyl)-sulfide, 3,5-di-t-butyl-4-hydroxybenzyl-dimethylamine and α,α'-(3,5-di-t-butyl-4-hydroxyphenyl)-dimethyl ether. These reducing agents can be jointly be used in admixture if desired.

A suitable reducing agent is selected depending on the organic silver salt used. For example, when a silver salt of a higher fatty acid such as silver behenate that is difficult to a reduce is used, a relatively strong reducing agent, for example, a bisphenol such as 4,4'-methylenebis-(3-methyl-5-t-butylphenol) is suitable. On the other hand, for a relatively readily reducible silver salt such as silver laurate, a relatively weak reducing agent, for example, a substituted phenol such as p-phenylphenol is suitable. Moreover, for a silver salt that is very difficult to reduce, such as silver benzotriazole, a strong reducing agent, for example, ascorbic acid is suitable.

The amount of the reducing agent of the invention, as described above, which is added can be varied depending on the kind of organic silver salt and kind of reducing agent used, but, ordinarily, about 0.1 to 5 mols per 1 mol of the organic silver salt (a) is suitable.

As is apparent from the foregoing description, a suitable reducing agent can be chosen for a given organic silver salt for the purpose of preparing the thermally developable light-sensitive material of the present invention and it is not necessary to specify particularly the organic silver salt or reducing agent.

Some of the optical sensitizing dyes conventionally used for silver halide emulsions can advantageously be used so as to increase the photosensitivity of the thermally developable light-sensitive material of the invention. As optical sensitizing dyes, cyanines, merocyanines and acid dyes are suitable.
Suitable examples of merocyanines which can be used are as follows:
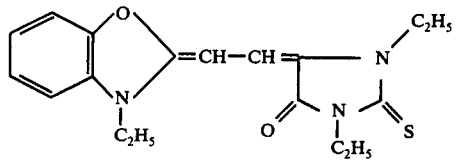
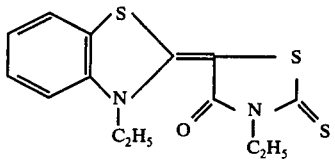
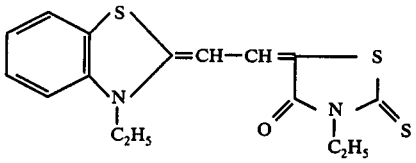
-continued
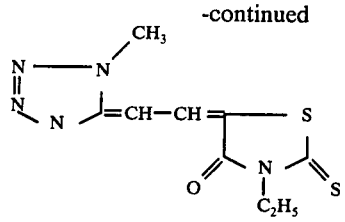
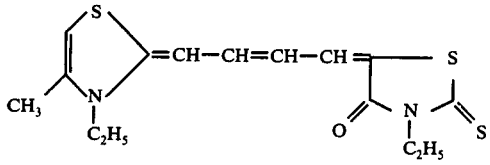
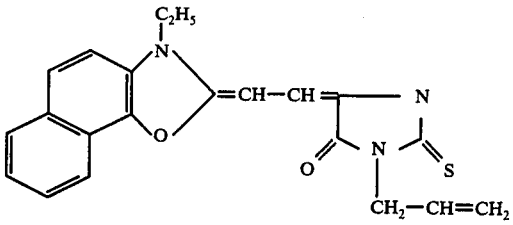
Suitable examples of cyanine dyes which are suitable are as follows:
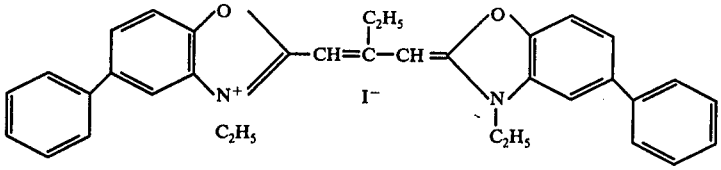
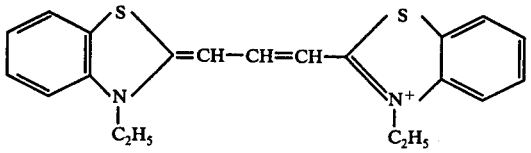
I⁻
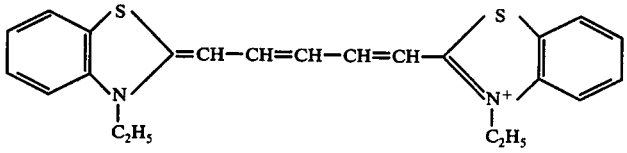
I⁻
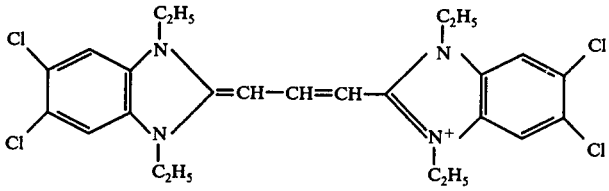
I⁻
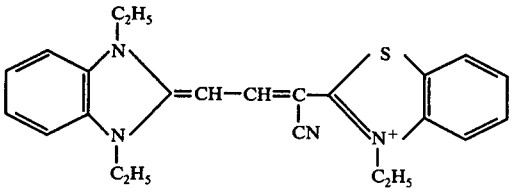
I⁻
Suitable examples of acid dyes which can be used are as follows:

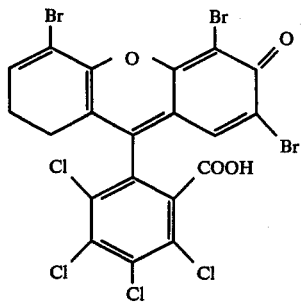

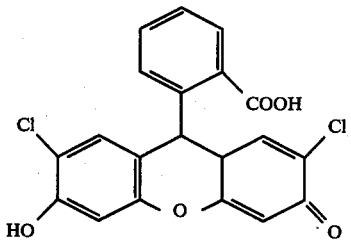

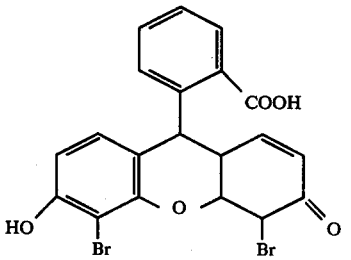

The content of these sensitizing dyes is preferably about $10^{-5}$ to $10^{-1}$ mol per 1 mol of the silver halide, component (b).

In the present invention, the components (a), (b) and (c) are dispersed in a binder (d) and applied to a support. On this occasion, all of the components (a), (b) and (c) can be dispersed in the binder and applied to a support as one layer or the components (a), (b) and (c) can be separately dispersed in a binder and applied as different layers.

Conventionally used material can be employed as the binder (d). A hydrophobic material is ordinarily used, but a hydrophilic material can also be used. These binders are preferably selected from transparent or semi-transparent natural materials such as gelatin and gelatin derivatives, mixtures thereof with latex-like vinyl type polymers, cellulose derivatives and synthetic polymeric materials. Illustrative specific examples binders are gelatin, phthalated gelatin, acrylamide, polyvinyl butyral, cellulose acetate butyrate, cellulose acetate propionate, polymethyl methacrylate, polyvinylpyrrolidone, polystyrene, ethyl cellulose, polyvinyl chloride, chlorinated rubber, polyisobutylene, butadienestyrene copolymer, vinyl chloride-vinyl acetate copolymer, vinyl acetate-vinyl chloride-maleic acid copolymer, polyvinyl alcohol, polyvinyl acetate, benzyl cellulose, cellulose acetate, cellulose propionate and cellulose acetate phthalate. These binders can be jointly used in admixture. The amount of the binder is about 10:1 to 1:10, preferably 4:1 to 1:4 on a weight basis to the organic silver salt. Where the component (a) or (c) is a high molecular weight material also having the ability to function as a binder, the binder can be omitted.

As the support of the invention, any material can be used. Typical examples of suitable supports are cellulose nitrate films, cellulose ester films, poly(vinylacetal)films, polycarbonate films, and glass, paper and metal sheets.

The amount of the above described binder dispersion provided on the support is generally about 0.2 to 3 $g/m^2$ computed as silver, preferably 0.4 to 2 $g/m^2$. If less than about 0.2 $g/m^2$ is employed, the maximum image density is reduced, while, if more than about 3 $g/m^2$ is used, the cost increases.

In the thermally developable light-sensitive material used for the practice of the present invention, an antistatic layer or an electrically conductive layer can be provided. Moreover, an antihalation material and an antihalation dye can be incoporated therein, if desired.

A matting agent such as starch, titanium dioxide, zinc oxide or silica and a brightening agent such as a stilbene-, triazine-, oxazole- or coumarin-type brightening agent can be incorporated in the thermally developable light-sensitive material used for the practice of the present invention.

Furthermore, in the light-sensitive layer of the thermally developable light-sensitive material of the invention, various additives such as heat fog inhibitors, color tone agents, stabilizers and compounds for inhibiting the discoloration of an image after the passage of time from the formation of the image can be included. Illustrative examples of heat fog inhibitors are N-chlorosuccinimide, N-bromosuccinimide, N-iodosuccinimide and the compounds described in Japanese Patent Application 8194/1973. Illustrative examples of color tone agents are phthalazinone, phthalimide, phthalazinedione and luminol. Illustrative examples of stabilizers are benzenesulfonic acid, p-toluenesulfonic acid, tetrabromophthalic acid and tetrabromophthalic anhydride. A higher sensitivity thermally developable light-sensitive material can be obtained by incorporating an inorganic halide represented by the foregoing general formula $MX'_{n_1}$ in the light-sensitive layer of the thermally developable light-sensitive material according to the invention.

The thermally developable light-sensitive layer of the invention can be coated onto a support using various coating methods, for example, an immersion method, an air knife method, a curtain coating method and an extrusion coating method using a hopper as described in U.S. Pat. No. 2,681,294. As the occasion demands, two or more layers can be coated simultaneously.

An overcoating polymer layer can be optionally provided on the light-sensitive layer in order to increase the transparency of the thermally developable light-sensitive layer, to increase the density of the image and to improve the storability (the ability of the material to retain on storage the photographic characteristics of a light-sensitive material immediately after the production thereof). The thickness of this overcoating polymer layer is preferably about 1 to 20 microns. Suitable polymers are, for example, polyvinyl chloride polyvinyl acetate, copolymers of vinyl chloride and vinyl acetate, polyvinyl butyral, polystyrene, polymethyl methacrylate, polyurethane rubbers, xylene resins, benzyl cellulose, ethyl cellulose, cellulose acetate butyrate, cellulose acetate, polyvinylidene chloride, chlorinated polypropylene, polyvinylpyrrolidone, cellulose propionate, polyvinyl formal, cellulose acetate phthalate, polycarbonate and cellulose acetate propionate.

When kaolin is incorporated in the overcoating polymer layer, the material can be written on with a ball-point pen after the image is formed.

The above described thermally developable light-sensitive material is imagewise exposed to radiation from a xenon lamp, a tungsten lamp or a mercury lamp and then can be developed simply by heating only a suitable and preferred wave-length for exposure which can be used ranges from about 300 nm to 800 nm and X-rays or electron beams are also suitable a suitable exposure time can range from about $10^{-10}$ second to $10^{3}$ second, more generally $10^{-9}$ second to $10^{2}$ second. The heating temperature usually ranges from about 100° to 160° C., preferably 110° to 140° C. Within this range, a higher temperature or lower temperature can be used by shortening or lengthening the heating time, appropriately. The developing time is ordinarily about 1 to 60 seconds.

Various methods can be employed for heating and developing the light-sensitive material of the invention, for example, by contacting the light-sensitive material with a simple heating plate or with a heated drum or by passing the light-sensitive material through a heated space. The heating can be carried out using high frequency or a laser beam if desired.

The following examples are given in order to illustrate the invention in greater detail without limiting the same. Unless otherwise indicated are parts, percents, ratios and the like are by weight.

EXAMPLE 1

To an aqueous solution (I) of cetylethyldimethylammonium bromide obtained by dissolving 0.95 of cetylethyldimethylammonium bromide in 20 ml of water with agitation was added an aqueous solution (II) of silver nitrate obtained by dissolving 0.425 g of silver nitrate in 5 ml of water at room temperature (about 20° to 30° C.) to prepare a dispersion (III) of silver bromide. A toluene solution (IV) of lauric acid obtained by dissolving 12 g of lauric acid in 150 ml of toluene and an aqueous solution (V) of sodium hydroxide obtained by dissolving 1.9 g of sodium hydroxide soda in 100 ml of water were added to this dispersion, stirred for 10 minutes with a stirrer and mixed with an aqueous solution (VI) of silver nitrate obtained by dissolving 8.5 g of silver nitrate in 5 ml of water with agitation to prepare silver laurate. The resulting precipitate was removed and ball-milled in 240 g of a 15% isopropanol solution of polyvinyl butyral (average polymerization degree-1000) to prepare a polymeric dispersion of a silver salt (silver laurate and silver bromide). To 20 g of the dispersion were added the following components to prepare a thermally developable light-sensitive coating emulsion and the emulsion was coated onto a support sheet in a silver quantity of 0.5 g per 1 $m^2$, thus obtaining thermally developable Light-Sensitive Material (A).

On the other hand, for comparison, the above described solutions (IV) and (V) were mixed, stirred for 10 minutes with a stirrer and then with agitation mixed with the above described solution (VI) to prepare silver laurate. This was dispersed in the isopropanol solution of polyvinyl butyral in the same manner as above to prepare a polymer dispersion of silver laurate. To 20 g of the dispersion were added the following components (Table 1) to prepare a thermally developable light-sensitive coating emulsion and the emulsion was coated onto a paper support sheet in a silver quantity of 0.5 g per 1 $m^2$ of the support, thus obtaining thermally developable Light-Sensitive Materials (B) and (C).

Table 1

| | | |
|---|---|---|
| (1)* | (i) Hydrogen bromide (0.5% methanol solution) | 2 ml |
| | (ii) Cetylethyldimethylammonium bromide (7.3% methanol solution) | 1 ml |
| (2) | 2',7'-Dichlorofluorescein (sensitizing dye) (0.025% methanol solution) | 3 ml |
| (3) | Phthalazinone (1.25% methanol solution) (black control agent) | 3 ml |
| (4) | p-Phenylphenol (20% acetone solution) | 3.5 ml |

*Light-sensitive Material (A): No Component (1) was added.
Light-sensitive Material (B): Only Component (1) was added.
Light-sensitive Material (C): Only Component (ii) was added.

These three Light-Sensitive Materials (A) to (C) were exposed through an optical wedge to radiation from a tungsten light source of 240,000 lux second, heated and developed at 120° C. for 30 seconds and the reflection density was measured. The reciprocal of an exposure quantity necessary to provide a reflection density 0.1 higher than fog was chosen as a measure of the sensitivity. The relative sensitivities are shown in the following table, with the sensitivity of Light-Sensitive Material (B) being set at 100:

| | Light-Sensitive Material | | |
|---|---|---|---|
| | (A) | (B) | (C) |
| Relative Sensitivity | 550 | 100 | 90 |

It is evident from the results in this table that Light-Sensitive Material (A) of the invention has a higher sensitivity.

COMPARATIVE EXAMPLE 1

In place of the aqueous solution (I) of cetylethyldimethylammonium bromide of Example 1, an aqueous solution (VII) of triethylbenzylammonium bromide obtained by dissolving 0.66 g of triethylbenzylammonium bromide in 20 ml of water was mixed with the aqueous solution (II) of silver nitrate used in Example 1 while stirring to prepare silver bromide. In this case, the silver bromide aggregated and precipitated.

In a manner analogous to Example 1, the toluene solution (IV) of lauric acid and aqueous solution (V) of sodium hydroxide were added thereto to prepare silver laurate, dispersed in the polyvinyl butyral solution, mixed with the same additives as in preparing the thermally developable Light-Sensitive Material (A) (Table 1) and applied to a support to prepare a thermally developable Light-Sensitive Material (D). When Light-Sensitive Material (D) was subjected to the same quantity of exposure as that of Example 1 and heated, no image was obtained.

EXAMPLE 2

An aqueous solution (I) of cetylethyldimethylammonium bromide as described in Example 1 was mixed with 130 ml of toluene and subjected to ultrasonic waves (UR-150 type manufactured by Tominage Seisakujo) for 10 minutes to obtain an emulsion. Then a aqueous solution (II) of silver nitrate as in Example 1 was added thereto with agitation to prepare a dispersion of silver bromide. To this dispersion were added a toluene solution (IV) of lauric acid and aqueous solution (V) of sodium hydroxide prepared as in Example 1, stirred for 10 minutes with a stirrer and the aqueous solution (VI) of silver nitrate was added with agitation to prepare silver laurate. In a manner analogous to Example 1, this was dispersed in an isopropanol solution of polyvinyl butyral to prepare a polymer solution of silver salts (silver laurate and silver bromide). To 20 g of the polymer dispersion were added the components described in Table 1 in Example 1, except for the omission of component (1), and the dispersion was coated onto a paper support in a silver quantity of 0.5 g/m$^2$, thus obtaining thermally developable Light-Sensitive Material (E). Similarly, to 20 g of the polymer dispersion were added the components described in Table 1 in Example 1 (including the component (1) (i)) and the dispersion was coated onto a paper support in a silver quantity of 0.5 g/m$^2$, thus obtaining thermally developable Light-Sensitive Material (F).

These light-sensitive materials were exposed under the same conditions as those of Example 1 and heated, thus obtaining the sensitivities as tabulated below:

| | Light-Sensitive Material | | |
|---|---|---|---|
| | (B)* | (E) | (F) |
| Sensitivity | 100 | 650 | 960 |

*Light-Sensitive Material prepared in Example 1

It is apparent from these results that a much higher sensitivity thermally developable light-sensitive material can be obtained by the joint use of the halide with the essential components (a) to (d) for the thermally developable light-sensitive material of the invention.

EXAMPLE 3

| | |
|---|---|
| 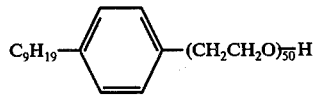 | 100 mg |
| $NH_4BR$ | 250 mg |

An aqueous solution (VII) of the above described two compounds dissolved in 20 ml of water was mixed with 100 ml of toluene and subjected to ultrasonic waves (UR-150 P type manufactured by Tominaga Seisakujo) for 10 minutes to obtain an emulsion. To this emulsion was added an aqueous solution (II) of silver nitrate as described in Example 1 with agitation at 150° C. to prepare a dispersion of silver bromide. Using this dispersion in place of the dispersion of silver bromide prepared as in Example 1, a polymer dispersion of silver salts (silver laurate and silver bromide) was prepared in a manner analogous to Example 1. To 20 g of this polymer dispersion were added the components described in Table 1 in Example 1 but omitting component (1) to prepare thermally developable Light-Sensitive Material (G) (coated silver quantity: 0.5 g/m$^2$). To 20 g of the same polymer dispersion were added the components as described in Table 1 in Example 1 (including component (1) (i)), thus obtaining thermally developable Light-Sensitive Material (H). This light-sensitive material was exposed under the same conditions as those of Example 1 and heated to obtain an image. The sensitivity thereof is tabulated below.

| | Light-Sensitive Material | | |
|---|---|---|---|
| | (B')* | (G) | (H) |
| Sensitivity | 150 | 430 | 620 |

*Light-Sensitive Material B' corresponds to Light-Sensitive Material B prepared in Example 1 except that 1 ml of a 1.25% methanol solution of $NH_4Br$ was added in place of the 0.5% methanol solution of hydrogen bromide.

As is evident from this result, the thermally developable light-sensitive material of the invention has a higher sensitivity.

EXAMPLE 4

An aqueous solution (VIII) of cetylethyldimethylammonium bromide prepared by dissolving 4.75 g of cetyldimethylammonium bromide in 50 ml of water was mixed with 250 ml of toluene at 35° C. and then subjected to ultrasonic waves (UR-150 P type manufactured by Tominaga Seisakujo) for 10 minutes to obtain an emulsion. To this emulsion was added an aqueous solution (IX) of silver nitrate obtained by dissolving 2.25 g of silver nitrate in 25 ml of water to prepare a dispersion of silver bromide.

A toluene solution (IV) of lauric acid and an aqueous solution (V) of sodium hydroxide as described in Example 1 were added to the dispersion, the mixture stirred for 10 minutes and mixed with an aqueous solution (III) of silver nitrate as described in Example 1 with stirring to prepare silver laurate. The resultant precipitate was removed and dispersed in 240 g of a 15% isopropanol solution of polyvinyl butyral using a homogenizer (manufactured by Nippon Seiki Seisakujo K.K.) to prepare a polymer dispersion of silver laurate. To the resulting polymer dispersion of silver laurate was added 60 ml of the above described dispersion of silver bromide and further dispersed using a homogenizer to prepare a polymer dispersion of silver salts (silver laurate and silver bromide).

To 20 g of the dispersion were added the components described in Table 1 in Example 1 but omitting component (1) to prepare a thermally developable light-sensitive coating emulsion and the emulsion was coated onto a support in a silver quantity of 0.5 g/m$^2$ to prepare thermally developable Light-Sensitive Material (I). This light-sensitive material was imagewise exposed under the same conditions as those of Example 1 and heated to obtain an image. The sensitivity was as follows:

| | Light-Sensitive Material | |
|---|---|---|
| | (B) | (I) |
| Sensitivity | 100 | 520 |

As is evident from this result, the thermally developable light-sensitive material of the invention has a higher sensitivity.

EXAMPLE 5

3.4 g of behenic acid was dissolved in 100 ml of toluene at 60° C. and controlled at 60° C. With stirring by a stirrer, this was mixed with 100 ml of a dilute aqueous solution of nitric acid (pH 2.0, 25° C.). The mixed solution was kept at 60° C., stirred using a stirrer and mixed with an aqueous solution containing a silver ammonium complex salt obtained by adding aqueous ammonia to about 80 ml of an aqueous solution containing 1.7 g of silver nitrate to prepare a silver ammonium complex salt followed by adding water to make the volume 100 ml, thus obtaining a dispersion containing fine crystals of silver behenate. When this dispersion was allowed to stand at room temperature (e.g., about 20° to 30° C.) for 20 minutes, separation into an aqueous phase and toluene phase occurred. The aqueous solution was firstly removed and 400 ml of fresh water was added followed by decantation. After repeating this procedure three times, 400 ml of toluene was added and the mixture subjected to centrifugal separation to obtain silver behenate. 2.5 g of the silver behenate was then added to 20 ml of an isopropanol solution containing 2 g of polyvinyl butyral and ball-milled for 1 hour to prepare a polymer emulsion. To 20 g of the polymer dispersion was added 5 ml of the dispersion of silver bromide prepared as described in Example 4 and further ball-milled for 1 hour to prepare a polymer dispersion of silver salts (silver behenate and silver bromide). To this dispersion were added the components described in Table 2 but omitting component (2) to prepare a thermally developable light-sensitive coating emulsion and the dispersion was coated onto a support of a polyethylene terephthalate film in a silver quantity of 1.5 g per 1 $m^2$ of the support, thus obtaining thermally developable Light-Sensitive Material (J).

To 20 g of a polymer dispersion of silver behenate free from the dispersion of silver bromide were added the components as described in Table 2 (adding the component (2) (i)) to prepare a thermally developable coating emulsion and the dispersion was coated onto a support of a polyethylene terephthalate film in a silver quantity of 1.5 g/$m^2$, thus obtaining thermally developable Light-Sensitive Material (K). Similarly, to 20 g of the polymer dispersion of silver behenate were added the components described in Table 2 (adding the component (2) (ii)) and the dispersion was coated to prepare thermally developable Light-Sensitive Material (L).

Table 2

| | | |
|---|---|---|
| (1) | N-Bromosuccinimide (2.5% Methyl Cellosolve solution) | 1 ml |
| (2) | (i) Ammonium bromide (2.5% methanol solution) | 1 ml |
| | (ii) Cetylethyldimethylammonium bromide (7.3% methanol solution) | 1 ml |
| (3) | Tetrachlorotetrabromofluorescein (1/40000 by weight methanol solution) | 10 ml |
| (4) | 2,2'-Methylenebis(6-t-butyl-4-methyl-phenol) (2.5% Methyl Cellosolve solution) | 3 ml |
| (5) | Phthalazinone (2.5% Methyl Cellosolve solution) | 1 ml |
| (6) | Tetrachlorophthalic anhydride (0.6% methanol solution) | 1 ml |

These light-sensitive materials were exposed under the same conditions as those of Example 1 and heated to obtain images. The relative sensitivities (the reciprocal of the exposure quantity to give a transmission density of fog + 0.1) are tabulated below, with the sensitivity of Light-Sensitive Material (K) being set at 100.

| | Light-Sensitive Material | | |
|---|---|---|---|
| | (J) | (K) | (L) |
| Sensitivity | 580 | 100 | 95 |

EXAMPLE 6

A mixed aqueous solution of cetylpyridinium bromide and ammonium iodide obtained by dissolving 0.72 g of cetylpyridinium bromide and 0.09 g of ammonium iodide in 30 ml of water was mixed with 100 ml of isoamyl acetate and subjected to ultrasonic waves (UR - 150 P type manufactured by Tominaga Seisakujo) for 10 minutes to form an emulsion. To this emulsion was added the aqueous solution (II) of silver nitrate as described in Example 1 with agitation at room temperature to prepare a dispersion of silver bromide. Then a mixed solution of toluene solution (IV) and an aqueous solution (V) of sodium hydroxide and the aqueous solution of silver nitrate, all as described in Example 1, were simultaneously added thereto to prepare silver laurate. The resultant precipitate was removed and dispersed in 240 g of a 15% isopropanol solution of polyvinyl butyral using a homogenizer (made by Nippon Seiki Seisakujo K.K.) to prepare a polymer dispersion of silver salts (silver laurate and silver bromide). To 20 g of this polymer dispersion were added the components as described in Table 1 in Example 1 but omitting component (1) to prepare a thermally developable light-sensitive coating emulsion and the resulting emulsion was coated onto a paper support in a silver quantity of 0.5 g/$m^2$, thus obtaining a thermally developable Light-Sensitive Material (M). The resulting Light-Sensitive Material (M) was imagewise exposed under the same conditions as those of Example 1 and heated to form an image. The sensitivity thereof is shown in the following table.

| | Light-Sensitive Material | |
|---|---|---|
| | (B) | (M) |
| Sensitivity | 100 | 1130 |

EXAMPLE 7

In place of the compound,

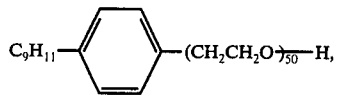

used in Example 3, the compound, $C_{16}H_{33}$—$COO(CH_2CH_2O)_{22}H$, was used in a manner analogous to Example 3 to prepare a dispersion of silver bromide (liquid temperature: 10° C.). 5 ml of this dispersion of silver bromide was dispersed in 20 ml of the polymer dispersion of silver behenate prepared as described in Example 5 for 1 hour in a ball mill to thus prepare a polymer dispersion of silver salts (silver behenate and silver bromide). The components as described in Table 2 in Example 5 but omitting component (2) were added thereto to prepare a thermally developable light-sensitive emulsion and coated onto a polyethylene terephthalate film in a silver quantity of 1.5 g/$m^2$ thus obtaining thermally developable Light-Sensitive Material (N). The resulting light-sensitive material was exposed under the same conditions as those of Example 1 and heated to obtain an image. The sensitivity thereof is shown in the following table.

| | Light-Sensitive Material | |
|---|---|---|
| | (K)* | (N) |
| Sensitivity | 100 | 540 |

*Light-sensitive Material prepared in Example 5

EXAMPLE 8

Thermally developable Light-Sensitive Materials (A'), (B') and (C') were obtained in the same manner as described in Example 1 except that Component (3) was not added. Thus Light-Sensitive Material (A) corresponds to Light-Sensitive Material (A), Light-Sensitive Material (B') corresponds to Light-Sensitive Material (B) and Light-Sensitive Material (C') corresponds to Light-Sensitive Material (C), each with the exception of Component (3) of Example 1.

In Light-Sensitive Material (A), (B) and (C) a black image was obtained, but in Light-Sensitive Material (A'), (B') and (C'), a yellow brown image was obtained. On comparing the ratio of the sensitivity of each of these Light-Sensitive Materials, the following results were obtained.

| | (A')/(A) | (B')/(B) | (C')/(C) |
|---|---|---|---|
| Ratio of Sensitivity | 0.95 | 0.92 | 0.93 |

So, it can be seen that Component (3) substantially does not influence the results of this invention.

In addition, Light-Sensitive Materials (A''), (B'') and (C'') were obtained in the same manner as described in Example 1 except that neither Component (2) nor Component (3) was added. Light-Sensitive Material (A'') corresponds to Light-Sensitive Material (A), Light-Sensitive Material (B'') corresponds to Light-Sensitive Material (B), Light-Sensitive Material (C'') corresponds to Light-Sensitive Material (C).

At this time, a yellow brown image was obtained. And the ratio of the sensitivity was as follows:

| | (A'')/(A) | (B'')/(B) | (C'')/(C) |
|---|---|---|---|
| Ratio of Sensitivity | 0.08 | 0.07 | 0.08 |

It can also be seen that Component (2) substantially does not influence results of this invention.

While the invention has been described in detail and with reference to specific embodiments thereof, it will be apparent to one skilled in the art that various changes and modifications can be made therein without departing from the spirit and scope thereof.

What is claimed is:

1. A thermally developable light-sensitive material comprising a support having thereon at least one layer containing (a) an organic silver salt, (b) a catalytic amount of a light-sensitive silver halide, (c) a reducing agent and (d) a binder, wherein the improvement comprises utilizing as said light-sensitive silver halide, a silver halide which was prepared in the absence of a protective colloid by mixing a solution of a compound capable of releasing a halide ion and a solution of a compound capable of releasing silver ion in the presence of a surface active agent, said silver halide also having been dispersed in a medium of an emulsion of a slightly water-soluble solvent in water present during the preparation of said light-sensitive silver halide.

2. The thermally developable light-sensitive material of claim 1, wherein said slightly water-soluble solvent has a solubility of 10 parts or less per 100 parts of water at 20° C.

3. The thermally developable light-sensitive material of claim 1, wherein said slightly water-soluble solvent has a solubility of 2 parts or less per 100 parts of water at 20° C.

4. The thermally developable light-sensitive material of claim 1, wherein said surface active agent is present in said solution of said compound capable of releasing a halogen ion.

5. The thermally developable light-sensitive material of claim 1, including dispersing the silver halide in a solvent selected from the group consisting of tricresyl phosphate, tributyl phosphate, monooctyldibutyl phosphate, dimethyl phthalate, dioctyl phthalate, dimethoxyethyl phthalate, amyl acetate, isoamyl acetate, isobutyl acetate, isopropyl acetate, isobutyl acetate, ethyl acetate, 2-ethylbutyl acetate, butyl acetate, propyl acetate, dioctyl sebacate, dibutyl sebacate, diethyl sebacate, diethyl succinate, propyl formate, butyl formate, amyl formate, ethyl valerate, diethyl tartarate, methyl butyrate, ethyl butyrate, butyl butyrate, isoamyl butyrate, pentane, hexane, heptane, cyclohexane, benzene, toluene and xylene with water.

6. The thermally developable light-sensitive material of claim 1, wherein the amount of the light-sensitive silver halide component (b) ranges from about 0.001 to 0.5 mole per mole of the organic silver salt component (a).

7. The thermally developable light-sensitive material of claim 1, wherein the reducing agent is a substituted phenol, a substituted or unsubstituted bisphenol, a substituted or unsubstituted naphthol, a di- or poly-hydroxybenzene, a di- or poly-hydroxynaphthalene, a hydroquinone monoether, ascorbic acid or a derivative thereof, a 3-pyrazolidone, a pyrazolin-5-one, a reducing saccharide, kojic acid, or hinokitiol.

8. The thermally developable light-sensitive material of claim 1, wherein the amount of the reducing agent component (c) ranges from about 0.1 to 5 moles per mole of the organic silver salt component (a).

9. The thermally developable light-sensitive material of claim 1, wherein said layer additionally contains at least one of an optical sensitizer, a fluorescent brightening agent, an anti-heat fogging agent, a toning agent, a stabilizing agent, and a matting agent.

10. The thermally developable light-sensitive material of claim 1, including a protective layer over said light-sensitive material.

11. The thermally developable light-sensitive material of claim 1, wherein said organic silver salt is a silver salt of an organic compound containing an imino group, a mercapto group or a carboxy group.

12. The thermally developable light-sensitive material of claim 1, wherein said compound capable of releasing a silver ion in a water soluble silver salt having a solubility of higher than about 0.2 g/100 g of water at 20° C.

13. The thermally developable light-sensitive material of claim 1 wherein the preparation of the silver-halide is carried out at a reaction temperature of 5° to 50° C.

14. The thermally developable light-sensitive material of claim 1, wherein the concentration of said surface active agent ranges from about 0.3 to 30% by weight.

15. The thermally developable light-sensitive material of claim 1, wherein a combination of water is used with said slightly water-soluble solvent, the ratio thereof to water ranging from 1:10 to 10:1.

16. The thermally developable light-sensitive material of claim 15, wherein said ratio ranges from 1:6 to 6:1.

17. The thermally developable light-sensitive material of claim 1, wherein each of said solution of said compound capable of releasing a halogen ion and said solution of said compound capable of releasing a silver ion is an aqueous solution or a solution of a polar solvent.

18. The thermally developable light-sensitive material of claim 17, wherein said solution is an aqueous solution.

19. The thermally developable light-sensitive material of claim 1, wherein said compound capable of releasing a halogen ion is an inorganic compound represented by the General Formula $$MX'_{n_1}$$

wherein M is a hydrogen atom, an ammonium group or a metal atom; X' is a halogen atom; and $n_1$ is 1 when M is a hydrogen atom or an ammonium group and $n_1$ is the valence of the metal atom when M is metal atom; or an organic halide compound selected from the group consisting of triphenylmethyl chloride, triphenylmethylbromide, monoiodoacetic acid, N-bromosuccinimide, N-bromoacetamide, N-iodoacetamide, iodoform and carbon tetrabromide.

20. The thermally developable light-sensitive material of claim 19 wherein said compound capable of releasing a silver ion is selected from the group consisting of silver nitrate, silver perchlorate, silver sulfate, silver acetate and a silver ammonium complex.

21. The thermally developable light-sensitive material of claim 20 wherein said compound capable of releasing a silver ion is silver nitrate.

22. The thermally developable light-sensitive material of claim 1, wherein said surface active agent is a cationic surface active agent, an anionic surface active agent, an amphoteric surface active agent, a non-ionic surface active agent, or an ionically compatible mixture thereof.

23. The thermally developable light-sensitive material of claim 22, wherein said compound capable of releasing a halogen ion is an inorganic compound represented by the General Formula $$MX'_{n_1}$$

wherein M is a hydrogen atom, an ammonium group or a metal atom; X' is a halogen atom; and $n_1$ is 1 when M is a hydrogen atom or an ammonium group and $n_1$ is the valence of the metal atom when M is metal atom; or an organic halide compound selected from the group consisting of triphenylmethyl chloride, triphenylmethylbromide, monoiodoacetic acid, N-bromosuccinimide, N-bromoacetamide, N-iodoacetamide, iodoform and carbon tetrabromide.

24. The thermally developable light-sensitive material of claim 22, wherein said surface active agent is present in said solution of said compound capable of releasing a halogen ion, in said solution of said compound capable of releasing silver ion, or in both of said solutions.

25. The thermally developable light-sensitive material of claim 22, wherein said surface active agent is a cationic surface active agent or a non-ionic surface active agent.

26. The thermally developable light-sensitive material of claim 25, wherein said surface active agent is a cationic surface active agent represented by the General Formula (I)

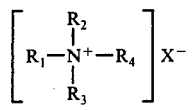

(I)

wherein $R_1$ is an alkyl group having 8 to 22 carbon atoms;

$R_2$, $R_3$ and $R_4$ each is an alkyl group having 1 to 10 carbon atoms or an aralkyl group; and X is an anion;

or an alkyl pyridinium salt represented by the General Formula (II)

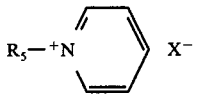

(II)

wherein $R_5$ is an alkyl group having from 8 to 22 carbon atoms;

and X is as defined with respect to General Formula (I); and wherein the pyridine ring moiety can be substituted with an alkyl group or an aryl group substituent.

27. The thermally developable light-sensitive material of claim 25, wherein said surface active agent is a non-ionic surfactant and is an alkyl ether compound having the General Formula (III)

$$R_6—O—(CH_2CH_2O)_mH \quad (III)$$

wherein $R_6$ is an alkyl group having 8 to 22 carbon atoms;

and m is an integer of 8 to 50;

an alkylaryl ether compound having the General Formula (IV)

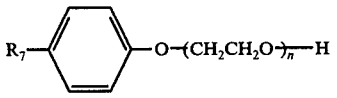

(IV)

wherein $R_7$ is an alkyl group having 4 to 10 carbon atoms; and n is an integer of 8 to 50;

an alkyl ester compound represented by the General Formula (V) or the General Formula (VI)

$$R_8—COO—(CH_2CH_2O)_pH \quad (V)$$

$$R_8—COO—(CH_2CH_2O)_{p_1}CH_2CH_2COOR_8 \quad (VI)$$

wherein $R_8$ is an alkyl group having 8 to 18 carbon atoms; and

*p* is an integer of 3 to 40;

a sorbitan monoalkyl ester compound having the General Formula (VII)

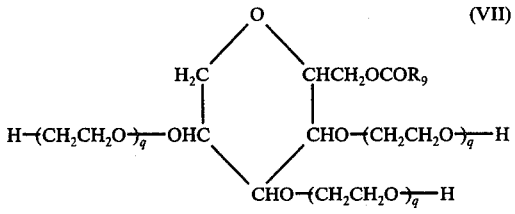

(VII)

wherein $R_9$ is an alkyl group having 8 to 18 carbon atoms; and $q$ is an integer of 5 to 30; or a polyoxyethylene alkylamine having the General Formula (VIII)

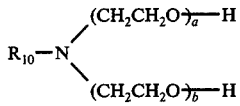

(VIII)

wherein $R_{10}$ is an alkyl group having 8 to 18 carbon atoms;

$a$ and $b$ each is an integer of 0 to 20; and the sum of $a$ and $b$ ranges from 6 to 40.

28. A thermally developable light-sensitive material comprising a support having thereon at least one layer containing (a) an organic silver salt, (b) a catalytic amount of a light-sensitive silver halide, (c) a reducing agent and (d) a binder, wherein the improvement comprises utilizing as said light-sensitive silver halide, a silver halide which was prepare in the absence of a protective colloid by mixing a solution of a compound capable of releasing a halide ion and a solution of a compound capable of releasing silver ion in the presence of a surface active agent, said silver halide also having been dispersed in a medium of an emulsion of a slightly water-soluble solvent in water after the preparation of said light-sensitive silver halide.

29. The thermally developable light-sensitive material of claim 28, wherein said compound capable of releasing a silver ion is a water soluble silver salt having a solubility of higher than about 0.2 g/100 g of water at 20° C.

30. The thermally developable light-sensitive material of claim 28, wherein the concentration of said surface active agent ranges from about 0.3 to 30% by weight.

31. The thermally developable light-sensitive material of claim 28, wherein said slightly water-soluble solvent has a solubility of 10 parts or less per 100 parts of water at 20° C.

32. The thermally developable light-sensitive material of claim 28, wherein said slightly water-soluble solvent has a solubility of 2 parts or less per 100 parts of water at 20° C.

33. The thermally developable light-sensitive material of claim 28, wherein said surface active agent is present in said solution of said compound capable of releasing a halogen ion.

34. The thermally developable light-sensitive material of claim 28, including dispersing the silver halide in a solvent selected from the group consisting of tricresyl phosphate, tributyl phosphate, monooctyldibutyl phosphate, dimethyl phthalate, dioctyl phthalate, dimethoxyethyl phthalate, amyl acetate, isoamyl acetate, isobutyl acetate, isopropyl acetate, isobutyl acetate, ethyl acetate, 2-ethylbutyl acetate, butyl acetate, propyl acetate, dioctyl sebacate, dibutyl sebacate, diethyl sebacate, diethyl succinate, propyl formate, butyl formate, amyl formate, ethyl valerate, diethyl tartarate, methyl butyrate, ethyl butyrate, butyl butyrate, isoamyl butyrate, pentane, hexane, heptane, cyclohexane, benzene, toluene and xylene with water.

35. The thermally developable light-sensitive material of claim 28, wherein the amount of the light-sensitive silver halide component (b) ranges from about 0.001 to 0.5 mole per mole of the organic silver salt component (a).

36. The thermally developable light-sensitive material of claim 28, wherein the reducing agent is a substituted phenol, a substituted or unsubstituted bisphenol, a substituted or unsubstituted naphthol, a di- or poly-hydroxybenzene, a di- or poly-hydroxynaphthalene, a hydroquinone monoether, ascorbic acid or a derivative thereof, a 3-pyrazolidone, a pyrazolin-5-one, a reducing saccharide, kojic acid, or hinokitiol.

37. The thermally developable light-sensitive material of claim 28, wherein the amount of the reducing agent component (c) ranges from about 0.1 to 5 moles per mole of the organic silver salt component (a).

38. The thermally developable light-sensitive material of claim 28, wherein said layer additionally contains at least one of an optical sensitizer, a fluorescent brightening agent, an anti-heat fogging agent, a toning agent, a stabilizing agent, and a matting agent.

39. The thermally developable light-sensitive material of claim 28, including a protective layer over said light-sensitive material.

40. The thermally developable light-sensitive material of claim 28, wherein said organic silver salt is a silver salt of an organic compound containing an imino group, a mercapto group or a carboxy group.

41. The thermally developable light-sensitive material of claim 28, wherein the preparation of the silver-halide is carried out at a reaction temperature of 5° to 50° C.

42. The thermally developable light-sensitive material of claim 28, wherein each of said solution of said compound capable of releasing a halogen ion and said solution of said compound capable of releasing a silver ion is an aqueous solution or a solution of a polar solvent.

43. The thermally developable light-sensitive material of claim 42, wherein said solution is an aqueous solution.

44. The thermally developable light-sensitive material of claim 28, wherein a combination of water is used with said slightly water-soluble solvent, the ratio thereof to water ranging from 1:10 to 10:1.

45. The thermally developable light-sensitive material of claim 44, wherein said ratio ranges from 1:6 to 6:1.

46. The thermally developable light-sensitive material of claim 28, wherein said compound capable of releasing a halogen ion is an inorganic compound represented by the General Formula $$MX'_{n_1}$$

wherein M is a hydrogen atom, an ammonium group or a metal atom;

X' is a halogen atom; and $n_1$ is 1 when M is a hydrogen atom or an ammonium group and $n_1$ is the valence of the metal atom when M is metal atom;

or an organic halide compound selected from the group consisting of triphenylmethyl chloride, triphenylmethylbromide, monoiodoacetic acid, N-bromosuccinimide, N-bromoacetamide, N-iodoacetamide, iodoform and carbon tetrabromide.

47. The thermally developable light-sensitive material of claim 46 wherein said compound capable of releasing a silver ion is selected from the group consisting of silver nitrate, silver perchlorate, silver sulfate, silver acetate and a silver ammonium complex.

48. The thermally developable light-sensitive material of claim 47, wherein said compound capable of releasing a silver ion is silver nitrate.

49. The thermally developable light-sensitive material of claim 28, wherein said surface active agent is a cationic surface active agent, an anionic surface active agent, an amphoteric surface active agent, a non-ionic surface active agent, or an ionically compatible mixture thereof.

50. The thermally developable light-sensitive material of claim 49, wherein said compound capable of releasing a halogen ion is an inorganic compound represented by the General Formula $$MX'_{n1}$$

wherein M is a hydrogen atom, an ammonium group or a metal atom;

X' is a halogen atom; and $n_1$ is 1 when M is a hydrogen atom or an ammonium group and $n_1$ is the valence of the metal atom when M is metal atom; or an organic halide compound selected from the group consisting of triphenylmethyl chloride, triphenylmethylbromide, monoiodoacetic acid, N-bromosuccinimide, N-bromoacetamide, N-iodoacetamide, iodoform and carbon tetrabromide.

51. The thermally developable light-sensitive material of claim 49, wherein said surface active agent is present in said solution of said compound capable of releasing a halogen ion, in said solution of said compound capable of releasing silver ion, or in both of said solutions.

52. The thermally developable light-sensitive material of claim 49, wherein said surface active agent is a cationic surface active agent or a non-ionic surface active agent.

53. The thermally developable light-sensitive material of claim 52, wherein said surface active agent is a cationic surface active agent represented by the General Formula (I)

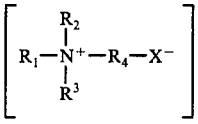

wherein $R_1$ is an alkyl group having 8 to 22 carbon atoms;

$R_2$, $R_3$ and $R_4$ each is an alkyl group having 1 to 10 carbon atoms or an aralkyl group; and X is an anion;

or an alkyl pyridinium salt represented by the General Formula (II)

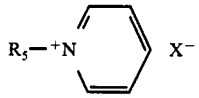

(II)

wherein $R_5$ is an alkyl group having from 8 to 22 carbon atoms;

and X is as defined with respect to General Formula (I); and wherein the pyridine ring moiety can be substituted with an alkyl group or an aryl group substituent.

54. The thermally developable light-sensitive material of claim 52, wherein said surface active agent is a non-ionic surfactant and is an alkyl ether compound having the General Formula (III)

$$R_6—O—(CH_2CH_2O)_m—H \quad (III)$$

wherein $R_6$ is an alkyl group having 8 to 22 carbon atoms;

and $m$ is an integer of 8 to 50;

an alkylaryl ether compound having the General Formula (IV)

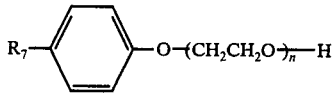

(IV)

wherein $R_7$ is an alkyl group having 4 to 10 carbon atoms; and $n$ is an integer of 8 to 50;

an alkyl ester compound represented by the General Formula (V) or the General Formula (VI)

$$R_8—COO—(CH_2CH_2O)_p—H \quad (V)$$

$$R_8—COO—(CH_2CH_2O)_{p1}—CH_2CH_2COOR_8 \quad (VI)$$

wherein $R_8$ is an alkyl group having 8 to 18 carbon atoms; and $p$ is an integer of 3 to 40;

a sorbitan monoalkyl ester compound having the General Formula (VII)

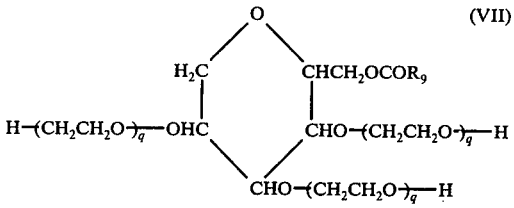

(VII)

wherein $R_9$ is an alkyl group having 8 to 18 carbon atoms;. and $q$ is an integer of 5 to 30; or a polyoxyethylene alkylamine having the General Formula (VIII)

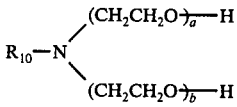

(VIII)

wherein $R_{10}$ is an alkyl group having 8 to 18 carbon atoms;

$a$ and $b$ each is an integer of 0 to 20; and the sum of $a$ and $b$ ranges from 6 to 40.

* * * * *